US011453963B2

(12) United States Patent
Ou et al.

(10) Patent No.: US 11,453,963 B2
(45) Date of Patent: Sep. 27, 2022

(54) METHODS AND APPARATUS FOR SENSOR OR CONTROLLER THAT INCLUDES KNITTED FABRIC

(71) Applicant: Massachusetts Institute of Technology, Cambridge, MA (US)

(72) Inventors: Jifei Ou, Cambridge, MA (US); Daniel Oran, Cambridge, MA (US); Don Haddad, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 543 days.

(21) Appl. No.: 16/571,191

(22) Filed: Sep. 16, 2019

(65) Prior Publication Data

US 2020/0087824 A1 Mar. 19, 2020

Related U.S. Application Data

(60) Provisional application No. 62/731,885, filed on Sep. 15, 2018.

(51) Int. Cl.

| | |
|---|---|
| ***D04B 1/14*** | (2006.01) |
| ***D04B 1/22*** | (2006.01) |
| ***D03D 1/00*** | (2006.01) |

(52) U.S. Cl.

CPC ..... *D04B 1/14* (2013.01); *D03D 1/0088* (2013.01); *D04B 1/22* (2013.01)

(58) Field of Classification Search

None

See application file for complete search history.

(56) References Cited

U.S. PATENT DOCUMENTS

| | | | |
|---|---|---|---|
| 6,970,731 | B1 | 11/2005 | Jayaraman et al. |
| 8,966,942 | B2 | 3/2015 | Dias et al. |

(Continued)

FOREIGN PATENT DOCUMENTS

| | | | |
|---|---|---|---|
| WO | 2002040091 | A2 | 5/2002 |
| WO | 2003094717 | A1 | 11/2003 |
| WO | 2017192167 | A1 | 11/2017 |

OTHER PUBLICATIONS

Atalay, O., et al., Knitted strain sensors: impact of design parameters on sensing properties; published in Sensors, 2014, 14, pp. 4712-4730, Mar. 2014.

(Continued)

*Primary Examiner* — Shawn Mckinnon

(74) *Attorney, Agent, or Firm* — Daly, Crowley, Mofford & Durkee LLP

(57) ABSTRACT

A sensor may include a knitted pocket and loose yarn that is inside a cavity of the pocket. In some cases, this loose yarn is neither woven, nor knit, nor otherwise part of a fabric. A resistive pressure sensor may include a knitted pocket and loose conductive yarn that is inside the pocket. Pressure applied to the pocket may compress the loose yarn, which may increase the number of electrical shorts between different parts of the loose yarn, which in turn may decrease the electrical resistance of the loose yarn. A capacitive sensor may include a knitted pocket and insulative loose yarn that is inside the pocket. A strain sensor may include knitted conductive pleats. Electrical shorts may occur in contact areas where neighboring pleats meet. As the strain sensor stretches, these contact areas may become smaller, causing the electrical resistance of the pleats as a group to increase.

14 Claims, 8 Drawing Sheets

(56) References Cited

U.S. PATENT DOCUMENTS

| | | | | |
|---|---|---|---|---|
| 10,123,740 | B2 | 11/2018 | Yan et al. | |
| 2009/0018428 | A1 | 1/2009 | Dias et al. | |
| 2016/0000374 | A1 | 1/2016 | Dandekar et al. | |
| 2017/0196514 | A1* | 7/2017 | Moltani ..... | A61B 5/6804 |

OTHER PUBLICATIONS

Bansal, N., et al., Textile Capacitors as Pressure Sensors; published as Poster, International Textile Conference, Nov. 2014.

Buechley, L., et al., Fabric PCBs, electronic sequins, and socket buttons: techniques for e-textile craft; published in Personal and Ubiquitous Computing, vol. 13, issue 2, pp. 133-150, Feb. 2009.

Pacelli, M., et al., Sensing Fabrics for Monitoring Physiological and Biomechanical Variables: E-textile solutions; published in 2006 3rd IEEE/EMBS International Summer School on Medical Devices and Biosensors, Sep. 2006.

Paradiso, R., et al., Textile electrodes and integrated smart textile for reliable biomonitoring; published in 2011 Annual International Conference of the IEEE Engineering in Medicine and Biology Society; 2011.

Poupyrev, I., et al., Project Jacquard: Interactive Digital Textiles at Scale; published in Proceedings of the 2016 CHI Conference on Human Factors in Computing Systems, CHI '16, pp. 4216-4227, May 2016.

* cited by examiner

METHODS AND APPARATUS FOR SENSOR OR CONTROLLER THAT INCLUDES KNITTED FABRIC

RELATED APPLICATIONS

This application claims the benefit of U.S. Provisional Application No. 62/731,885 filed Sep. 15, 2018 (the "Provisional").

FIELD OF TECHNOLOGY

The present invention relates generally to sensors or controllers that include knitted fabric.

SUMMARY

In some implementations of this invention, a sensor includes a knitted pocket and loose yarn that is inside a cavity of the pocket. We sometimes refer to this loose yarn as "infill" yarn or "interior" yarn. In some cases, this loose yarn is neither woven, nor knit, nor otherwise part of a fabric.

In some implementations, a resistive pressure sensor includes a knitted pocket and loose yarn that is inside a cavity of the pocket. The loose yarn may comprise at least one conductive yarn and at least one insulative yarn. When pressure is applied to the pocket, the loose yarn—including the conductive yarn—may compress, which may increase the number and size of electrical shorts between different parts of the conductive loose yarn. This in turn may decrease the electrical resistance of the loose yarn.

In some cases, a capacitive sensor may include a knitted pocket and insulative loose yarn that is inside a cavity of the pocket. The insulative loose yarn may be sufficiently rigid to provide mechanical resistance when a user presses against the knitted pocket. Thus, the insulative loose yarn may provide tactile feedback to a user who is pressing against the knit pocket.

In some cases, the capacitive sensor is what we call a single-plate capacitive sensor, in which the knitted pocket includes one conductive wall. The single-plate capacitor may measure capacitance between the conductive wall and a finger of a human user. The measured capacitance may increase as the finger comes nearer to the conductive wall. Likewise, when the finger is pressing against the knitted pocket, the contact area between the finger and the conductive wall may increase as the pressure increases, causing the measured capacitance to increase. Based on the measured capacitance, a computer may determine pressure or distance or detect touch or proximity.

In some cases, a capacitive pressure sensor is what we call a double-plate capacitive sensor, in which the knitted pocket includes two conductive walls. The double-plate capacitor may measure capacitance between the two conductive walls.

In some cases, a resistive strain sensor includes knitted pleats and a knitted, elastic layer. The knitted elastic layer may comprise insulative yarn, such as spandex. The knitted pleats may comprise conductive yarn. Neighboring conductive pleats may touch each other in contact areas. Electrical shorts may occur in the contact areas. Neighboring pleats may slide or shear at least partially past each other as the elastic layer stretches along its length. The contact areas between neighboring pleats may decrease in size as the elastic layer stretches. This in turn may cause the electrical resistance of the pleats as a group to increase.

In some cases, a rheostat is employed to control one or more other devices. The rheostat may comprise: (a) two conductive, knitted strips; (b) other regions knitted from insulative yarn; and (c) a moveable conductive object that creates an electrical short between the two conductive strips. Moving the movable object to different positions along the length of the two conductive strips may cause the position of the electrical short to change, which in turn may change the length of a path that electricity travels through the conductive strips and moveable object. This in turn may change the electrical resistance along that path. In some cases, the movable object is solid and is not a fabric. For instance, the movable solid object may comprise a metal buckle, a metal magnet, or an LED (light-emitting diode).

The Summary and Abstract sections and the title of this document: (a) do not limit this invention; (b) are intended only to give a general introduction to some illustrative implementations of this invention; (c) do not describe all of the details of this invention; and (d) merely describe non-limiting examples of this invention. This invention may be implemented in many other ways. Likewise, the Field of Technology section is not limiting; instead it identifies, in a general, non-exclusive manner, a field of technology to which some implementations of this invention generally relate.

BRIEF DESCRIPTION OF THE DRAWINGS

The above Figures are not necessarily drawn to scale. FIGS. 2-12 show illustrative implementations of this invention, or provide information that relates to those implementations. The examples shown in the Figures do not limit this invention. This invention may be implemented in many other ways.

DETAILED DESCRIPTION

Knitted Structure, Generally

Figure 1:
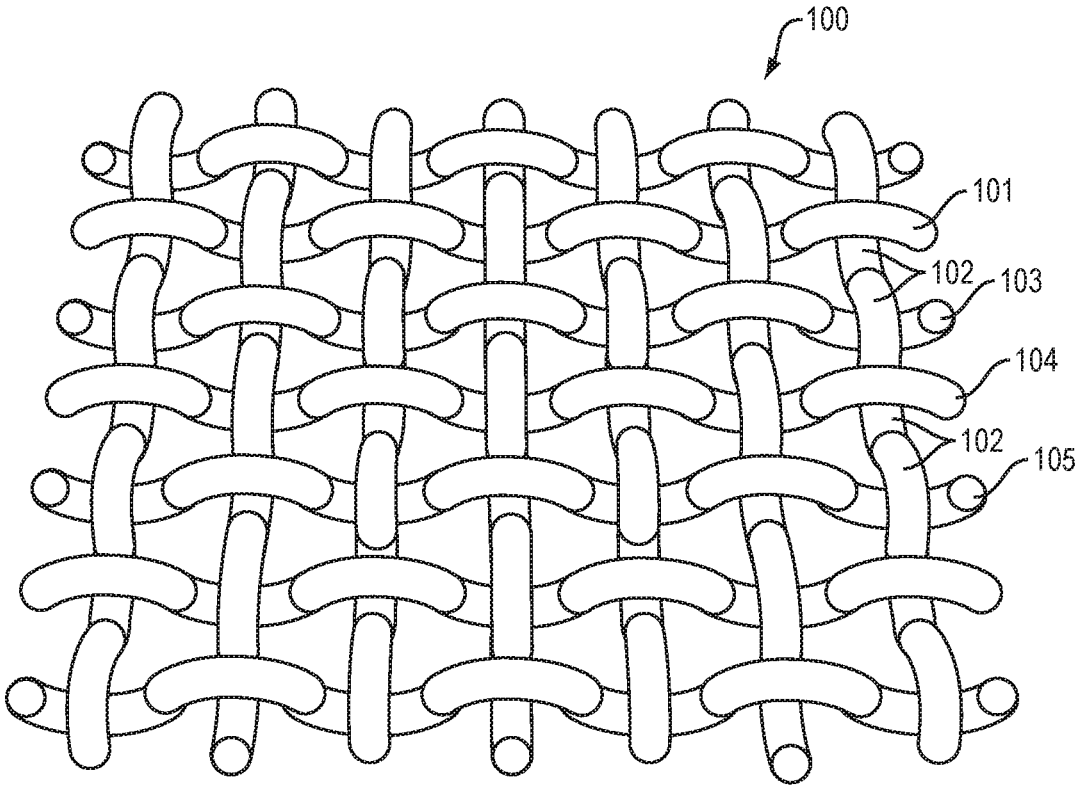
FIG. 1 shows a top view of a woven fabric.

Conventional textile sensors are often embedded in a woven fabric. For instance, the woven fabric may have a "thread over/under thread" structure, such as in a plain weave. FIG. 1 shows a top view of a conventional woven fabric 100, in which warp and weft threads are interwoven. For instance, in the woven pattern shown in FIG. 1, warp thread 102 goes under weft thread 101, then over weft thread 103, then under weft thread 104, and then over weft thread 105.

In many implementations of this invention, a knitted fabric—instead of a woven fabric—is employed.

In illustrative implementations of this invention, an electrical device (e.g., a sensor or variable resistor) includes a knitted structure. In some cases, conductive yarns are knit directly into the knitted structure and form all or part of the knitted structure.

There are at least three advantages to using a knitted fabric. First, conductive yarn may be embedded in, and may be all or part of, the knitted fabric. Second, the knitted fabric may be produced by a digitally controlled knitting machine. Thus, fabrication may be easily scaled. Third, machine knitting may produce knitted materials with special geometries, such as multilayered knitted structures, knitted structures with pockets, and 2.5D or 3D knitted structures. For instance, by varying stitches during knitting, a digitally controlled machine may produce 2.5D or 3D knitted structures. These knitted materials with special geometries may facilitate fabrication of knitted structures with embedded sensors or embedded rheostats.

In some implementations of this invention, the knitted fabric has a "loop through loop" spatial pattern. The knitted fabric may comprise a series of interconnected loops.

Figure 2:
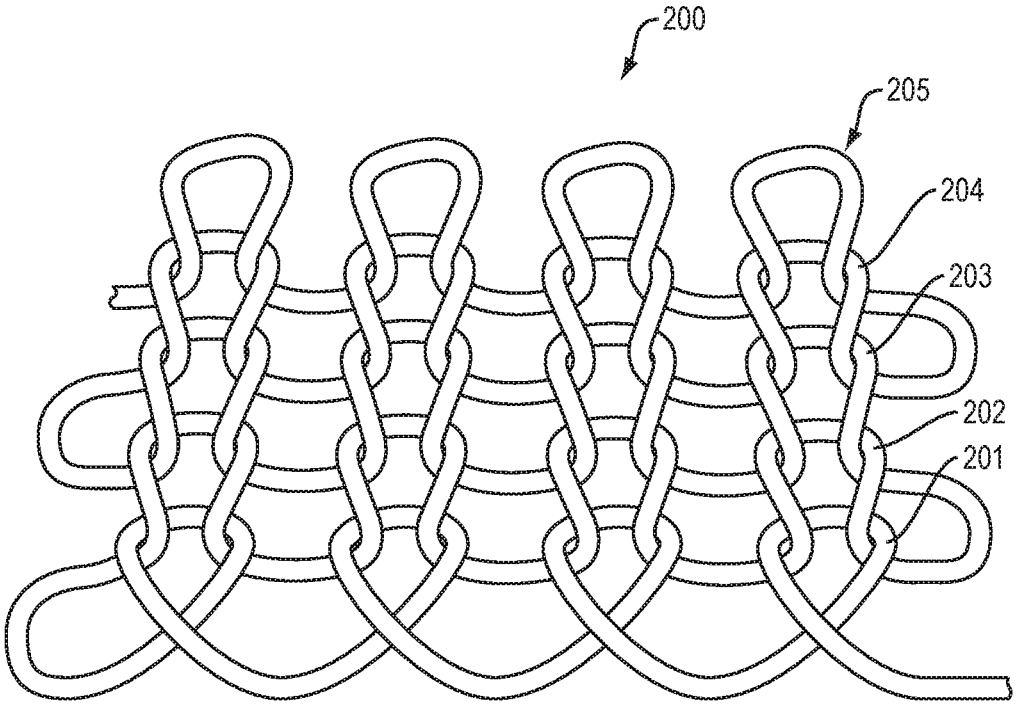
FIGS. 2 and 3 each show a top view of a knit fabric.
Figure 3:
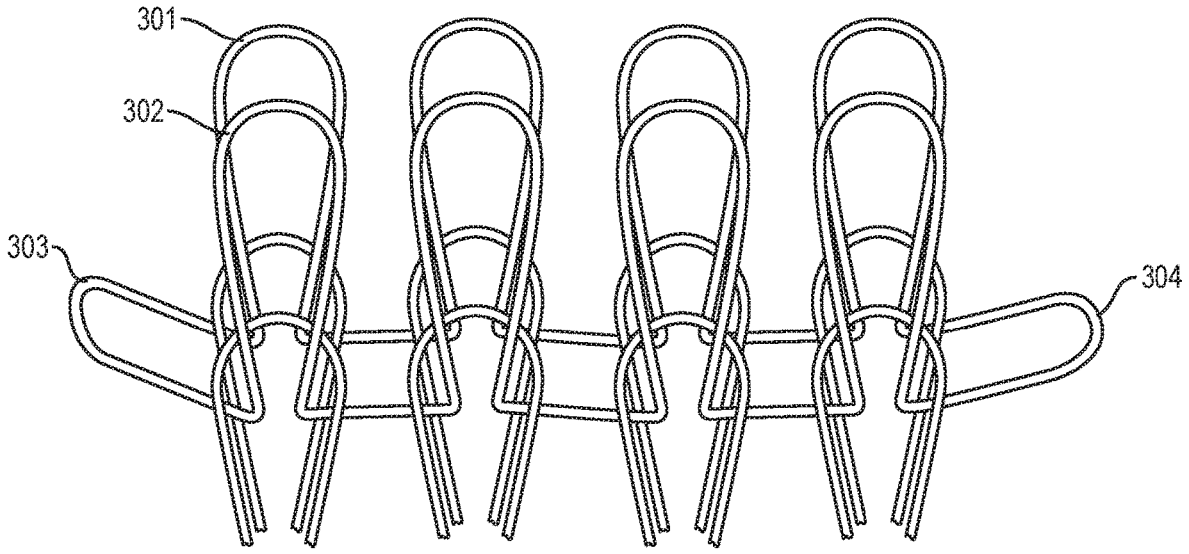

FIGS. 2 and 3 show examples of knit patterns, in illustrative implementations of this invention. FIGS. 2 and 3 are both top views.

In FIG. 2, a stockinette knitted fabric 200 has a "loop through loop" spatial pattern. For instance, in FIG. 2: (a) the stockinette stitch pattern includes loops of yarn such as loops 201, 202, 203, 204, and 205; (b) loop 202 goes through loop 201; (c) loop 203 goes through loop 202; (d) loop 204 goes through loop 203; and (e) loop 205 goes through loop 204.

Likewise, in FIG. 3, a tube-shaped knitting structure includes a front layer 301, a back layer 302 and yarn (e.g., yarn in regions 303 and 304) that connects the two layers along edges (e.g., a perimeter) of the layers. In FIG. 3, the front layer 301 and the back layer 302 are each knitted in a stockinette pattern. This stockinette pattern has a "loop through loop" spatial pattern.

In some implementations, a knitted pocket is formed by repeatedly knitting in a tube-shaped pattern (e.g., the tube-shaped pattern shown in FIG. 3).

In some implementations, a relatively inelastic knitted structure is formed by knitting in an interlocked pattern, in which stitches are made alternately on a front bed and back bed of a two bed (or V-bed) knitting machine.

More generally, in illustrative implementations of this invention, any knitting pattern may be employed. In some cases: (a) all or part of an electrical device (e.g., sensor or rheostat) comprises a knitted fabric; and (b) any knitting pattern may be employed to knit the fabric. For instance, in some cases, the knitted fabric includes one or more of the following types of knitting stitches: knit stitch; purl stitch; missed stitch; tuck stitch; plain stitch; reverse-knit stitch; elongated stitch (stitch that is longer than other stitches in the fabric); and plaited stitch (e.g., left-crossed stitch or right-crossed stitch). In some cases, the knitted fabric includes one or more of the following types of knitting patterns: stockinette stitch, stocking stitch; reverse stockinette stitch; garter stitch; seed stitch; moss stitch; faggoting; tricot; ribbing; welting; cables; warp knit; tube-shaped knit; and interlocked knit.

In some cases, the knitted fabric consists of only one yarn. In other cases, the knitted fabric comprises multiple yarns. In some cases, each yarn in the knitted fabric is conductive. In other cases, at least one yarn in the knitted structure is conductive and at least one other yarn in the knitted structure is insulative.

Figure 4:
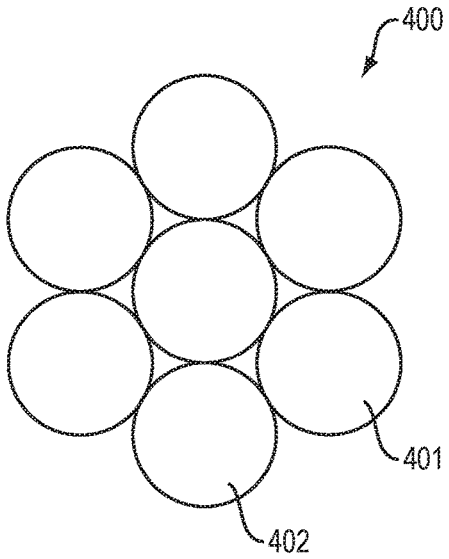
FIG. 4 shows a cross-section of a yarn.

In some cases, each conductive yarn comprises conductive fibers that are twisted together. In other cases, each conductive yarn includes conductive fibers and insulative fibers that are twisted together. FIG. 4 shows a cross-section of a yarn 400. Yarn 400 comprises multiple fibers (e.g., 401, 402) that are twisted together. If yarn 400 is conductive, then all or some of the fibers in yarn 400 are conductive. Likewise, if yarn 400 is insulative, all of the fibers in the yarn may be insulative.

In some cases, each conductive fiber (in a conductive yarn) includes an insulative core that is coated by a conductor. For instance, in some cases, a thin film of conductive nanoparticles (e.g., silver nanoparticles that range in maximum dimension from 20 to 200 nanometers) coats a dielectric core. In other cases, each conductive fiber is conductive throughout its entire cross-section.

In some cases, conductive yarns readily make good electrical contact with each other inside a knitted structure while maintaining their structural and electrical integrity.

Conductors, Insulators

As noted above, a knitted material may include conductive or insulative materials.

As used herein, to say that a material is "conductive" or is a "conductor" means that the material has, at 20 degrees Celsius, an electrical resistivity that is less than $10^{-6}$ Ω·m.

As used herein, to say that a material is "insulative" or is an "insulator" means that the material has, at 20 degrees Celsius, an electrical resistivity that is greater than $10^{8}$ Ω·m.

The preceding two definitions do not require that a material be at 20 degrees Celsius in order to be conductive or insulative. Instead, these two definitions specify what the electricity resistivity of a conductive or insulative material would be, if the material were at 20 degrees Celsius.

As used herein, "Ω·m" means ohm-meter.

In some implementations of this invention, insulative yarn comprises one or more of the following materials: polyester, nylon, polyamide, acetate, spandex, elastane, elastomer, and polymer.

In some implementations of this invention, conductive yarn comprises one or more of the following materials: copper, aluminum, gold, silver, and conductive polymer.

Spandex

In some implementations of this invention, all or some of the insulative yarns in the knitted structure comprise a polyether-polyurea copolymer. For instance, the polyether-polyurea copolymer may comprise spandex or elastane (including any spandex or elastane sold under the Lycra®, Elaspan®, or Acepora® brand names). Spandex yarns in a knitted structure: (a) may cause the structure to be elastic; and (b) may enable elasticity of the knitted structure to be precisely tuned by controlling stitch tension.

Bonding Yarn

In some implementations of this invention, bonding yarn is employed to reduce elasticity of a knitted structure. The bonding yarn may comprise a thermoplastic or thermosetting polymer. For instance, the bonding yarn may comprise a thermoplastic polyurethane (TPU) thread that melts at temperatures between 45 to 160 degrees Celsius. The bonding yarn may be knit together with other yarns (e.g., conductive yarn or insulative yarn) to form a knitted structure. The knitted structure may initially be elastic. The bonding yarn may then be heated above its melting temperature (e.g., by a steam iron), causing the bonding yarn to melt. The melted material may then cool and solidify around other yarns in the knit structure, causing the knit structure to be inelastic, while still flexible. After the melted material solidifies, it may comprise a thermoplastic material that is attached to or fused with yarn.

Machine Knitting

In some implementations, the knitted structure is knit by a digitally controlled knitting machine. The knitting machine may be programmable and may, by an automated process, form interlocked loops from single or multiple threads of yarn. The knitting machine may include an array of hooks, called needles, that form and hold the loops. Yarn may enter the machine from a cone, and then pass through a tensioning device and a yarn carrier, before being knit into a fabric. A single knitting machine may have multiple yarn carriers that are employed in one knitting program. Yarn carriers may move laterally by the machine head, positioning new yarn when needed. As the yarn is positioned, the needles may rise up to grab the yarn to form new loops. The knitting machine may knit multiple yarns in parallel or sequential order.

For instance, the knitting machine (which fabricates the knitted structure) may comprise a two-bed or V-bed knitting machine, which has two arrays of needles. These two arrays of needles are sometimes called the back bed and front bed. These two beds may fabricate two layers of knitted fabric that are connected at the end to form a tube shape, or that are connected at every other loop to form a single sheet.

The knitting machine may have tunable parameters such as tension, take-down speed and cam speed. In machine knitting, the tension parameter may control the tightness of the stitches. Specifically, the tension setting may refer to the distance that each needle pulls down after a knitting movement. In some cases, the higher the tension number is, the longer is the distance that each needle pulls down after a knitting movement, and thus the looser the stitches are. When machine knitting with conductive yarn, the tension parameter may influence not only the dimension of the knitted object, but also the conductivity, by changing the contacting area of the conductive yarn.

In some implementations, the stitch tension is tuned to knit tight when knitting with spandex so that the elasticity of the yarn is more dominant than that formed by its loops. In some cases, the tension setting varies for each type of yarn (e.g., conductive yarn, polyester yarn or spandex yarn) or varies depending on the particular structure being knit.

Pleated Resistive Strain Sensor

FIGS. 5A, 5B, 5C and 5D show a pleated resistive strain sensor, in an illustrative implementation of this invention.

In FIGS. 5A-5D, the strain sensor includes: (a) an elastic, knitted, insulative bottom layer 501; and (b) and a spatial sequence of conductive, knitted pleats 502. For instance, bottom layer 501 may comprise spandex. Bottom layer 501 may be elongated: e.g., its length may be at least five times greater than its height and at least five times greater than its width. Bottom layer 501 may undergo stretching (elastic, tensile strain) along its longitudinal axis 504, when subjected to tensile stress in directions 505 and 506. When the stretch is released, bottom layer 501 may return to (or almost to) its initial dimensions, with little or no hysteresis.

Conductive pleats 502 may comprise knitted conductive yarn and may lie flat or almost flat against each other, due to gravity.

Figure 5A:
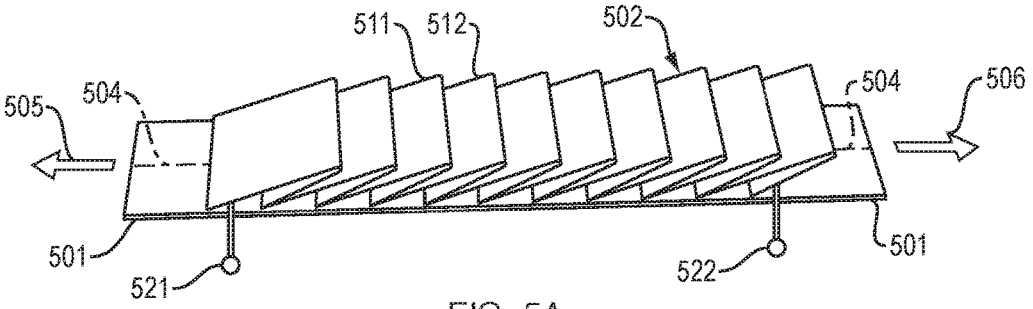
FIGS. 5A, 5B, 5C and 5D show a pleated resistive strain sensor.
Figure 5B:
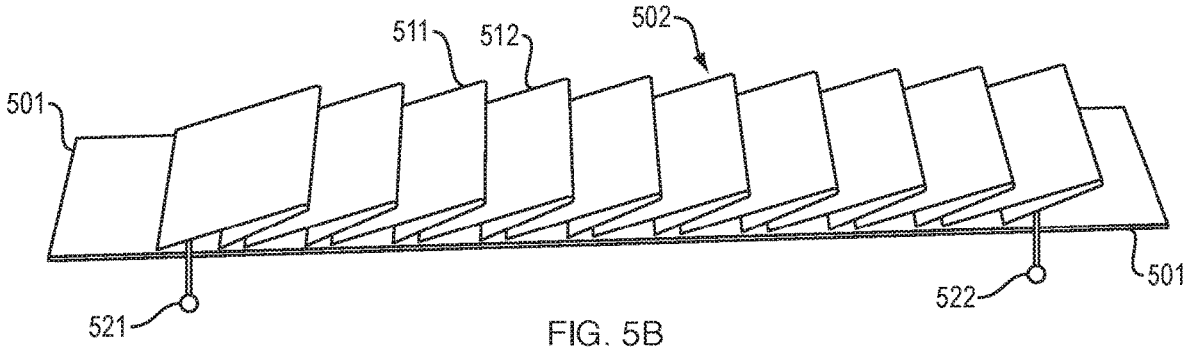

In FIGS. 5A and 5B, a first end of the sequence of conductive pleats 502 is electrically connected to a first node 521 of an electrical circuit of a resistive sensor. Also, a second end of the sequence of conductive pleats 502 is electrically connected to a second node 522 of the electrical circuit. Electrical shorts may occur in contact areas between neighboring conductive pleats (e.g., between pleats 511 and 512), thereby completing the circuit (by creating an electrical path between nodes 521 and 522).

In some cases: (a) electrical shorting occurs between two neighboring conductive pleats; even though (b) the two pleats are not attached to each other and are free to slide (shear) past each other. For instance, in some cases, electrical shorting occurs in a contact area between two neighboring conductive pleats, but the two pleats are—at least in the contact area—neither knitted to each other, nor woven to each other, nor fused with each other, nor bonded to each other (e.g., by chemical or mechanical bonds). Likewise, in some cases, in a contact area between a first conductive pleat and a second conductive pleat: (a) the two pleats touch each other and electrically short; (b) yarn in the first pleat is not knitted to yarn in the second pleat; (c) loops of the first pleat do not go through loops of the second pleat and loops of the second pleat do not go through loops of the first pleat; (c) yarn in the first pleat is not interwoven with yarn in the second pleat; (d) yarn in the first pleat is not bonded to or fused with yarn in the second pleat; and (e) yarn in the first pleat is free to slide or shear past yarn in the second pleat.

In the example shown in FIGS. 5A-5D, the amount of contact area between neighboring pleats varies depending on the degree to which bottom layer 501 is stretched. As bottom layer 501 becomes more stretched: (a) the contact area between neighboring conductive pleats may decrease; and (b) electrical resistance of the sequence of pleats 501 may increase because total contact area (in which electrical shorts occur) decreases. Likewise, as bottom layer 501 contracts (becomes less stretched): (a) the contact area between neighboring conductive pleats may increase; and (b) electrical resistance of the sequence of pleats 501 may decrease because total contact area (in which electrical shorts occur) increases.

Figure 5C:
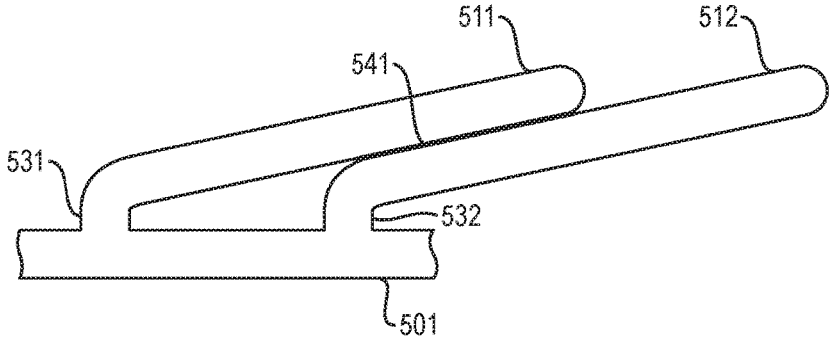
Figure 5D:
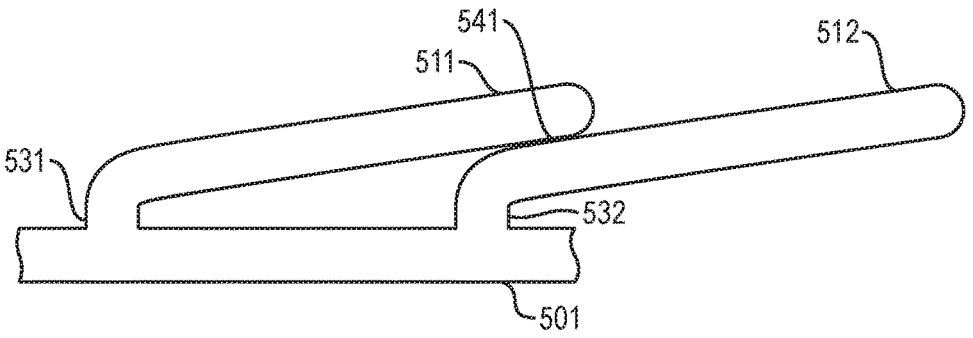

FIGS. 5C and 5D show a "zoomed-in" view of a portion of the pleated resistance sensor. FIGS. 5C and 5D illustrate how contact area between neighboring pleats 511, 512, changes as the bottom layer 501 stretches or contracts along its longitudinal axis. When bottom layer 501 stretches along its longitudinal axis, neighboring plates 511, 512 slide (shear) at least partially past each other, reducing the contact area between them. In contrast, when bottom layer 501 contracts along its longitudinal axis, neighboring plates 511, 512 slide (shear) past each other in the opposite direction, increasing the contact area between them.

In FIG. 5C: (a) bottom layer 501 is fully contracted (i.e., not stretched); (b) the bases 531 and 532 of pleats 511 and 512, respectively, are close to each other; and (c) contact region 541 (where pleat 511 touches pleat 512) is relatively large. In contrast, in FIG. 5D: (a) bottom layer 511 is stretched; (b) bases 531 and 532 of pleats 511 and 512, respectively, are farther apart from each other; and (c) contact region 541 (where pleat 511 touches pleat 512) is relatively small. Specifically, contact region 541 is smaller in FIG. 5D than in FIG. 5C. Likewise, the distance between the bases 531 and 532 (of pleats 511 and 512, respectively) is greater in FIG. 5D than in FIG. 5C.

In some cases, sequence of pleats 502 is connected in, and comprises, an electrical series, due to electrical short circuits between neighboring pleats.

In the example shown in FIGS. 5A and 5B, sequence of pleats 502 is not interdigitated. Sequence of pleats 502 does not comprise a first set of structures ("digits") that is interdigitated with a second set of structures ("digits").

Rheostat

In some implementations of this invention, a rheostat comprises: (a) two conductive strips of knitted, conductive yarn; (b) insulative regions of knitted, insulative yarn; and (c) a solid, conductive object that is movable relative to the remainder of the rheostat, that is not a fabric, and that creates an electrical short between the two conductive strips. The knitted, insulative regions may include an insulative region that is located between the two conductive strips. Thus, the two conductive strips may be electrically isolated from each other, except where they are shorted by the movable, solid, non-fabric, conductive object. Moving the solid, non-fabric, conductive object: (a) may change the path length of a portion of a circuit; and (b) may thus change the resistance of that portion of the circuit.

FIGS. 6, 7A, 7B and 7C illustrate two examples of a rheostat, in illustrative implementations of this invention.

Figure 6:
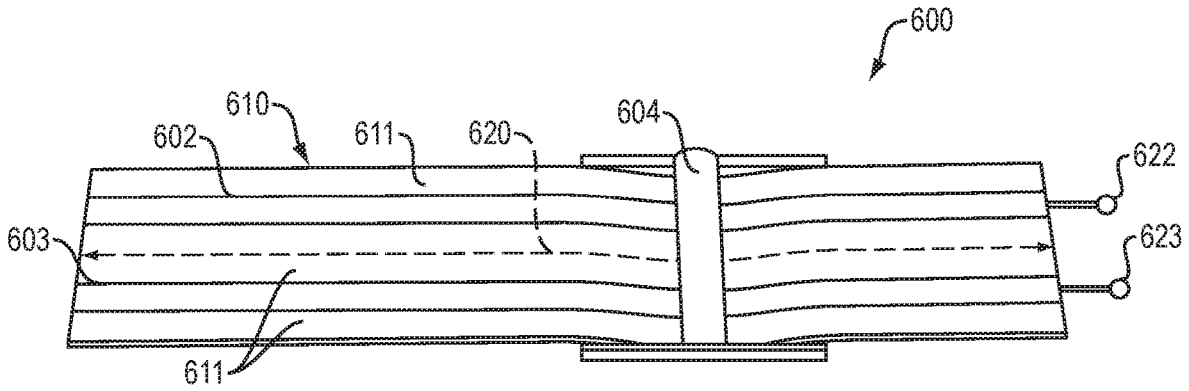
FIG. 6 shows a rheostat with a sliding buckle.

In FIG. 6, a rheostat 600 comprises a belt 610 and a metal buckle 604. Belt 610 comprises: (a) two conductive strips 602, 603 of knitted, conductive yarn; and (b) insulative regions 611 that are knitted. The insulative regions 611 may include polyester yarn and fused bonding yarn (which has been melted and then solidified).

In FIG. 6, conductive strips 602 and 603 are electrically connected to a first node 622 and a second node 623, respectively, of an electrical circuit. Metal buckle 604 creates an electrical short between the two conductive strips 602, 603 and thus completes the circuit.

Belt 610 may be elongated: e.g., its length may be at least five times greater than its height and at least five times greater than its width. Belt 610 may have a longitudinal axis 620. Metal buckle 604 may be moved to different positions along the length of belt 610 (i.e., to different positions along longitudinal axis 620).

Moving metal buckle 604 to different positions along the length of belt 610 changes the path length (and thus the electrical resistance) of the circuit portion that runs from first node 622 to second node 622 via conductive strip 602, buckle 604 and conductive strip 603.

In the rheostat shown in FIG. 6, it may be desirable to limit the elasticity of the belt. Thus, in FIG. 6, the insulative regions 611 of the belt may be knit from both insulative yarn and bonding yarn. The bonding yarn may be heated and then solidified, to cause the insulative regions 611 of the belt to be flexible but relatively inelastic. Also, the insulative regions 611 of the belt may be knit in an interlocking knit pattern, to further limit elasticity of the belt.

In a prototype of this invention: (a) the insulative regions of a belt rheostat were fabricated with one thread of 400 denier ultra-high molecular weight polyester and one thread of 150 denier TPU bonding yarn; (b) each conductive strip of the belt rheostat was fabricated with one thread of 450 denier silver-coated conductive yarn; and (c) the belt was steam ironed to melt the TPU bonding yarn at approximately 100 degrees Celsius. The prototype described in this paragraph is a non-limiting example of this invention.

Figure 7A:
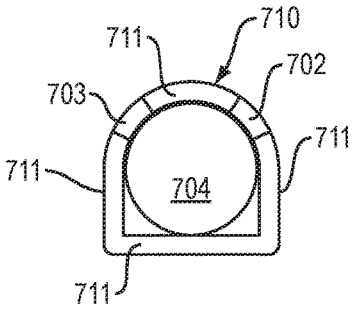
FIGS. 7A, 7B and 7C show a rheostat with a movable magnet.
Figure 7B:
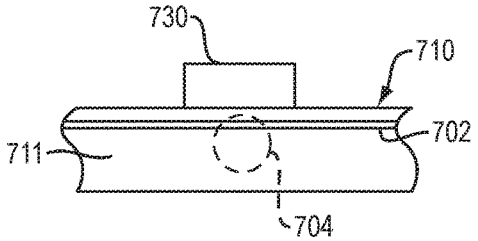
Figure 7C:
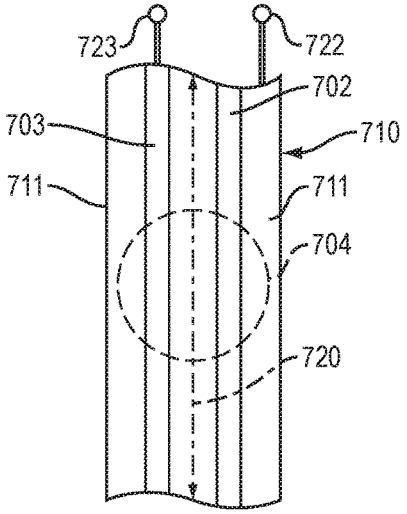

In FIGS. 7A, 7B and 7C, a rheostat comprises a tube 710 and a magnet 704. Tube 710 comprises: (a) two conductive strips 702, 703 of knitted, conductive yarn; and (b) insulative regions 711 that are knitted. The insulative regions 711 may include polyester yarn and fused bonding yarn (which has been melted and then solidified). In some cases, magnet 704 comprises a neodymium ball magnet.

In FIGS. 7A, 7B and 7C, conductive strips 702 and 703 are electrically connected to a first node 722 and a second node 723, respectively, of an electrical circuit. Magnet 704 creates an electrical short between the two conductive strips 702, 703 and thus completes the circuit.

Tube 710 may be elongated: e.g., its length may be at least five times greater than its height and at least five times greater than its width. Put differently, tube 710 may comprise an elongated pocket. Tube 710 may have a longitudinal axis 720. Magnet 704 may be moved to different positions along the length of tube 710 (i.e., to different positions along longitudinal axis 720). This movement of magnet 704 (which is inside tube 710) may be actuated by translating magnetic token 730 (which is external to the tube but close to the tube) along the length of the tube.

Moving magnet 704 to different positions along the length of tube 710 changes the path length (and thus the electrical resistance) of a circuit portion that runs from first node 722 to second node 723 via conductive strip 702, magnet 704 and conductive strip 703.

In the rheostat shown in FIG. 7, tube 710 may be knit from spandex and may thus be highly elastic. This may be desirable if tube 710 is narrow and must stretch to accommodate magnet 704. Alternatively (e.g., if tube 710 is wider), it may be desirable to limit the elasticity of tube 710. In that alternative scenario, the insulative regions 711 of the tube may be knit from both insulative yarn and bonding yarn. The bonding yarn may be heated and then solidified, to cause the insulative regions 711 of the tube to be flexible but relatively inelastic. Also, the insulative regions 711 of the tube may be knit in an interlocking knit pattern, to further limit elasticity of the tube.

In a prototype of this invention: (a) the insulative regions of a tube rheostat were fabricated with one thread of 400 denier ultra-high molecular weight polyester and one thread of 150 denier TPU bonding yarn; (b) each conductive strip of the tube rheostat was fabricated with one thread of 450 denier silver-coated conductive yarn; and (c) the belt was steam ironed to melt the TPU bonding yarn at approximately 100 degrees Celsius. The prototype described in this paragraph is a non-limiting example of this invention.

Pocket; Infill Yarns

In some implementations of this invention, a knitted pocket surrounds what we sometimes call "infill" yarns or "interior" yarns. The infill yarns may be loose threads that are not attached to each other and that are not part of a fabric. For instance, in some implementations: (a) the infill yarns are not woven; (b) the infill yarns are not knitted; and (c) the infill yarns are not bonded together (e.g., by chemical or mechanical bonds). Likewise, in some cases, the infill yarns are not part of a solid, composite material in which yarns are bound together (e.g., by a thermoset polymer).

In some cases, the infill yarns: (a) are inside a cavity of a knitted pocket; and (b) touch an interior surface of the cavity but are not attached to the interior surface.

In some cases, the infill yarns (in a pocket) are insulative. In some cases, the infill yarns (in a pocket) are conductive. In yet other cases, the infill yarns (in a pocket) are both conductive yarns and insulative yarns.

Resistive Pressure Sensor

In some implementations of this invention, a resistive pressure sensor includes: (a) a knitted pocket that is insulative; (b) two knitted electrodes that pass through walls of the pocket; and (c) infill yarns that are inside a cavity of the pocket. The infill yarns may comprise at least one conductive yarn and at least one insulative yarn. The infill yarns may be loose, not attached to each other and not part of a fabric. Put differently, in some cases, the infill yarns are inside the cavity of the knitted pocket but are not themselves knitted, woven or otherwise part of a fabric.

How much empty space exists in the pocket—i.e., how tightly the infill yarns are squeezed together inside the cavity formed by the pocket—may depend on the amount of compressive pressure exerted on an exterior wall of the pocket. For instance, as the compressive pressure exerted on the pocket increases: (a) the infill yarns in the pocket may become more tightly packed; (b) the density of the infill yarns inside the pocket may increase; and (c) the amount of empty space inside the pocket may decrease. Likewise, as the compressive pressure exerted on the pocket decreases: (a) the infill yarns in the pocket may become more loosely packed; (b) the density of the infill yarns inside the pocket may decrease; and (c) the amount of empty space inside the pocket may increase.

As used herein, the "density" of yarns inside a cavity means a fraction, the numerator of which is the volume of the yarns inside the cavity and the denominator of which is the total volume of the cavity.

A first knitted electrode (which passes through a wall of the pocket) may be electrically connected to a first node of an electrical circuit. A second knitted electrode (which passes through a wall of the pocket) may be electrically connected to a second node of the electrical circuit. For instance, the two knitted electrodes may pass through opposite walls of the pocket. Each of these knitted electrodes may touch at least one conductive infill yarn inside the pocket. The conductive infill yarn(s) inside the pocket may complete the circuit, by creating an electrical path between the first electrode and the second electrode.

Contact areas may occur where different parts of a conductive infill yarn touch each other or where different conductive infill yarns touch each other. Electrical shorts may occur in these contact areas.

Changing the pressure exerted on a wall of the pocket may change the number and/or size of these contact areas (where electrical shorts occur) and thus may cause the electrical resistance of the infill yarns to vary. For instance, as the compressive pressure exerted on an exterior wall of the pocket increases: (a) the number and/or size of the contact areas (where electrical shorts occur) may increase; and (b) thus the resistance of the infill yarns between the first and second knitted electrodes may decrease. Likewise, as the compressive pressure exerted on an exterior wall of the pocket decreases: (a) the number and/or size of the contact areas (where electrical shorts occur) may decrease; and (b) thus the electrical resistance of the infill yarns between the first and second knitted electrodes may increase.

Figure 8A:
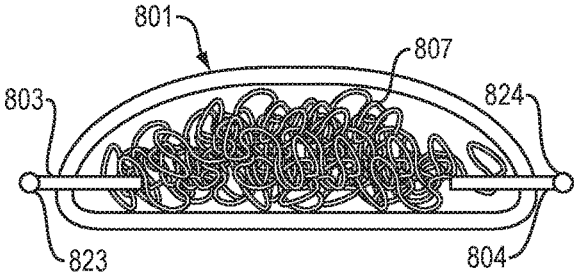
FIGS. 8A and 8B show a resistive pressure sensor, with infill yarn inside a knitted pocket.
Figure 8B:
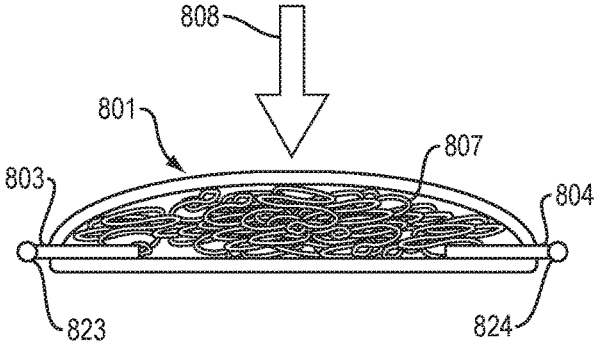

FIGS. 8A and 8B show a resistive pressure sensor, in an illustrative implementation of this invention. This pressure sensor includes: (a) a knitted pocket 801 that is insulative; (b) two knitted electrodes 803, 804 that pass through the walls of the pocket; and (c) infill yarns 807 that are inside a cavity of the pocket. The infill yarns 807 comprise at least one conductive yarn and at least one insulative yarn. The infill yarns 807 are loose, not attached to each other and not part of a fabric. The infill yarns 807 are inside the cavity of the knitted pocket 801 but are not themselves knitted, woven or otherwise part of a fabric. The infill yarns 807 touch an interior surface of the cavity but are not attached to the interior surface.

In FIGS. 8A and 8B, knitted electrodes 803 and 804 are electrically connected to a first node 823 and a second node 824, respectively, of an electrical circuit of a resistance sensor. Each knitted electrode 803, 804 touches at least one conductive infill yarn inside the pocket.

In FIGS. 8A and 8B, compressive pressure may be exerted against pocket 801 in direction 808. Changing the pressure exerted on a wall of pocket 801 changes the number and/or size of contact areas between different parts of a conductive infill yarn or between different conductive infill yarns. This in turn causes the electrical resistance of the infill yarns to vary. For instance: (a) as the compressive pressure exerted on an exterior wall of pocket 801 increases, the number and/or size of the contact areas increases and the electrical resistance of infill yarns 807 between the first and second knitted electrodes decreases; and (b) as the compressive pressure exerted on an exterior wall of pocket 801 decreases, the number and/or size of the contact areas decreases and the electrical resistance of infill yarns 807 between the first and second knitted electrodes increases.

The pressure exerted against resistive sensor is less in FIG. 8A than in FIG. 8B. Thus: (a) the infill yarns are more tightly squeezed in FIG. 8B than in FIG. 8A; and (b) the electrical resistance of the infill yarns is less in FIG. 8B than in FIG. 8A.

Single-Plate Capacitive Sensor

In some implementations of this invention, a single-plate capacitive sensor includes: (a) a knitted pocket that includes a conductive wall (e.g., a conductive top wall of the pocket); (b) insulative infill yarns that are inside a cavity of the pocket; and (c) a knitted electrode that is electrically grounded. The infill yarns may be loose, not attached to each other and not part of a fabric. Put differently, in some cases, the infill yarns are inside the cavity of the knitted pocket but are not themselves knitted, woven or otherwise part of a fabric.

In this single-plate capacitive sensor, the capacitance being measured is between: (a) the conductive wall of the knitted pocket; and (b) a finger of a human user. The user may touch the grounded knitted electrode with another part of her body (e.g., a palm of a hand). Touching the grounded knitted electrode may cause the user to be electrically grounded.

In some use scenarios, the user's finger is close to, but not touching, the conductive wall of the knitted pocket. In these use scenarios, the single-plate capacitive sensor may: (a) measure distance between the user's finger and the conductive wall; or (b) measure proximity (e.g., whether the finger is within a threshold distance from the conductive wall). To measure distance or proximity, the capacitive sensor may measure capacitance between the finger and the conductive wall of the knitted pocket. As the finger comes nearer—i.e., as the distance between the finger and conductive wall decreases—the capacitance (between the finger and the conductive wall) increases. Likewise, as the finger moves further away—i.e., as the distance between the finger and conductive wall increases—the capacitance (between the finger and the conductive wall) decreases.

In some use scenarios, the user's finger is touching the conductive wall of the knitted pocket. In these use scenarios, the single-plate capacitive sensor may detect the touch or may measure pressure applied by the finger against the knitted pocket. To detect touch or measure pressure, the capacitive sensor may measure capacitance between the finger and the conductive wall of the knitted pocket. As the pressure applied by the finger against the conductive wall increases, the contact area between the finger and the conductive wall increases, and thus the capacitance (between the finger and the conductive wall) increases. Likewise, as the pressure applied by the finger against the conductive wall decreases, the contact area between the finger and the conductive wall decreases, and thus the capacitance (between the finger and the conductive wall) decreases.

Figure 9A:
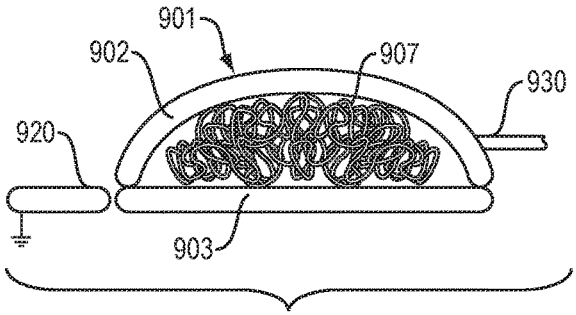
FIGS. 9A and 9B show a single-plate capacitive sensor, with infill yarn inside a knitted pocket.
Figure 9B:
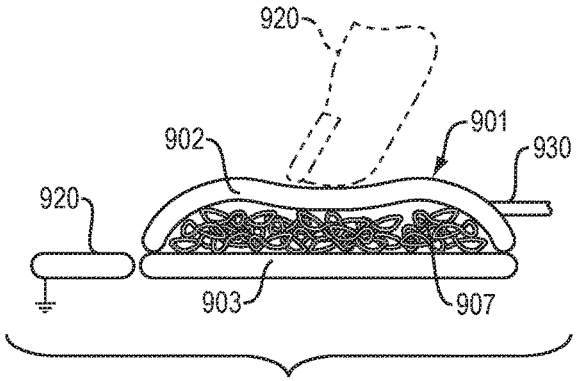

FIGS. 9A and 9B show a single-plate capacitive sensor, in an illustrative implementation of this invention.

In the example shown in FIGS. 9A and 9B, a single-plate capacitive sensor includes: (a) a knitted pocket 901; (b)

insulative infill yarns 907 that are inside a cavity of the pocket; and (c) a knitted electrode 920 that is electrically grounded. A top wall 902 of knitted pocket 901 is conductive and is knitted from conductive yarn. A bottom wall 903 of knitted pocket 901 is insulative and is knitted from an insulative yarn, such as polyester.

In FIGS. 9A and 9B, infill yarns 907 may be loose, not attached to each other and not part of a fabric. Put differently, in some cases, the infill yarns 907 are inside a cavity of the knitted pocket but are not themselves knitted, woven or otherwise part of a fabric. The infill yarns 907 touch an interior surface of the cavity but are not attached to the interior surface.

In the example shown in FIGS. 9A and 9B, the top conductive wall 902 of the knitted pocket is electrically connected (e.g., by metal wire 930) to capacitive sensing hardware. In some cases, the capacitive sensing hardware comprises a Teensy®3.2 USB development board which includes a 32-bit ARM®-Cortex® M4 microprocessor, capacitive touch inputs and Touch Sensor Interface (TSI) software.

In FIG. 9B, a user's finger 920 is pressing down against the knitted pocket 901. Thus, the pressure exerted against knitted pocket 901 is greater in FIG. 9B than in FIG. 9A.

Double-Plate Capacitive Sensor

In some implementations of this invention, a double-plate capacitive sensor includes: (a) a knitted pocket; and (b) insulative infill yarns that are inside a cavity of the pocket. The infill yarns may be loose, not attached to each other and not part of a fabric. Put differently, in some cases, the infill yarns are inside the cavity of the knitted pocket but are not themselves knitted, woven or otherwise part of a fabric.

In this double-plate capacitive sensor, the knitted pocket may include two conductive walls and an insulative region between the two conductive walls. For instance, the two conductive walls may be a top wall and a bottom wall of the pocket. The insulative region may comprise side walls of the pocket.

In this double-plate capacitive sensor, the capacitance being measured is between the two conductive walls of the pocket.

The double-plate capacitive sensor may measure pressure applied by a user's finger against the knitted pocket. To do so, the capacitive sensor may measure capacitance between the top and bottom walls of the knitted pocket. As the pressure applied by the finger against the knitted pocket increases, the top wall of the pocket moves closer to the bottom wall of the pocket, and thus the capacitance (between the top and bottom walls) increases. Likewise, as the pressure applied by the finger against the conductive wall decreases, the top wall of the pocket moves farther from the bottom wall of the pocket, and thus the capacitance (between the top and bottom walls) decreases. The top wall may move apart from the bottom wall as pressure decreases, because the infill yarn may tend to spring back elastically to its initial shape (or semi-elastically to almost its initial shape) as pressure decreases.

Figure 10A:
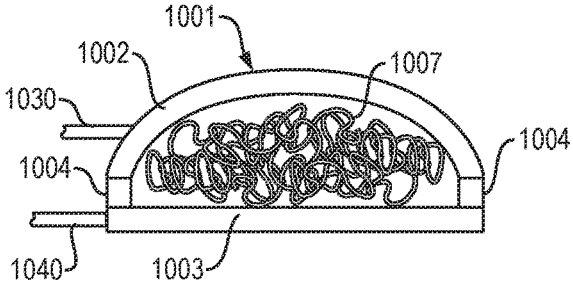
FIGS. 10A and 10B show a double-plate capacitive sensor, with infill yarn inside a knitted pocket.
Figure 10B:
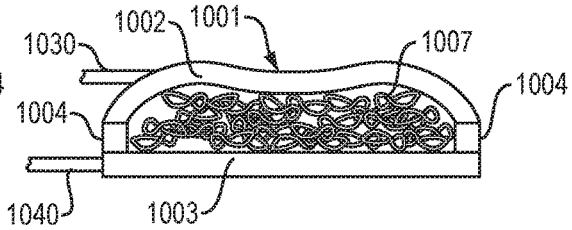

FIGS. 10A and 10B show a double-plate capacitive sensor, in an illustrative implementation of this invention.

In the example shown in FIGS. 10A and 10B, a double-plate capacitive sensor includes: (a) a knitted pocket 1001; and (b) insulative infill yarns 1007 that are inside a cavity of the pocket. Knitted pocket 1001 includes: (a) a top wall 1002; (b) a bottom wall 1003; and (c) an insulative region 1004 between the top and bottom walls. The top wall 1002 and bottom wall 1003 are each conductive and are each knitted from conductive yarn. The insulative region may be knitted from an insulative yarn (such as polyester, nylon or spandex) or from both an insulative yarn and bonding yarn.

Infill yarns 1007 may be loose, not attached to each other and not part of a fabric. Put differently, in some cases, the infill yarns 1007 are inside a cavity of the knitted pocket 1001 but are not themselves knitted, woven or otherwise part of a fabric. The infill yarns 1007 touch an interior surface of the cavity but are not attached to the interior surface.

In the example shown in FIGS. 10A and 10B, the top conductive wall 1002 and bottom conductive wall 1003 of the knitted pocket are electrically connected (e.g., by metal wires 1030 and 1040) to capacitive sensing hardware. In some cases, the capacitive sensing hardware comprises a Teensy®3.2 USB development board which includes a 32-bit ARM®-Cortex® M4 microprocessor, capacitive touch inputs and TSI software. In some cases, the capacitive sensing hardware measures capacitance: (a) by applying a fixed-frequency AC-voltage signal across a capacitive divider, or (b) by employing a relaxation oscillator.

In FIG. 10B, a user's finger is pressing down against the knitted pocket 1001. Thus, the pressure exerted against knitted pocket 1001 is greater in FIG. 10B than in FIG. 10A.

Tactile Feedback

When a user pushes a finger against an exterior wall of a knitted pocket (e.g., 801, 901, 1001), the infill yarns inside the pocket may be sufficiently stiff to provide tactile feedback to the user. Put differently, the infill yarns inside the knitted pocket may mechanically resist being compressed, and thus a user may feel mechanical resistance from the knitted pocket, as the user presses down against the pocket.

Stitch and Material for Knitted Pocket

In some cases, a knitted pocket (e.g., 801, 901, 1001) is knitted using a tube-shaped stitch pattern (such as the stitch pattern shown in FIG. 3). A knitted pocket (e.g., 801, 901, 1001) may include knitted regions that are conductive and knitted regions that are insulative. Alternatively, a knitted pocket may consist of only insulative yarn, such as spandex or polyester. In some cases, knitted pocket (e.g., 801, 901, 1001) is knitted from both insulative yarn and bonding yarn, and then heated to melt the bonding yarn. When the melted material solidifies, it may cause the knitted pocket to be flexible but relatively inelastic.

Inserting Yarn into Cavity of Pocket

In some implementations of this invention, infill yarn is inserted into the cavity of a knitted pocket. For instance, infill yarn may be inserted into the cavity of a knitted pocket to create: a resistive pressure sensor (e.g., the sensor shown in FIGS. 8A and 8B); a single-plate capacitive sensor (e.g., the sensor shown in FIGS. 9A and 9B), or a double-plate capacitive sensor (e.g., the sensor shown in FIGS. 10A and 10B).

In some implementations, the infill yarns are—both before and after being inserted in the cavity of a knitted pocket: (a) not attached to each other; and (b) neither knitted, nor woven, nor otherwise part of a fabric. Put differently, the infill yarns may be loose threads, both before and after being inserted into a cavity of a knitted pocket.

In some cases, pressurized air is employed to insert infill yarn into a knitted pocket.

Figure 11:
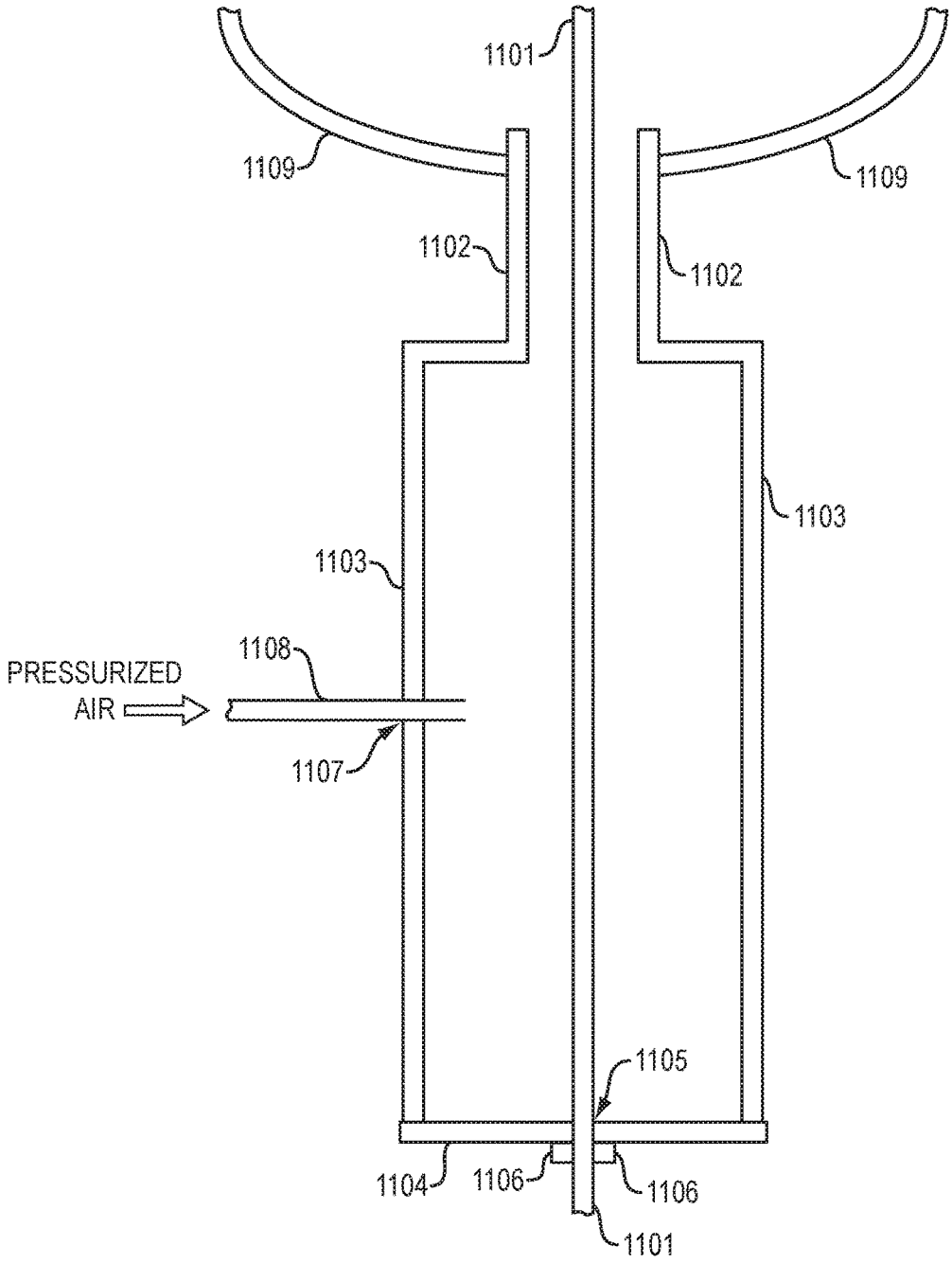
FIG. 11 shows a mechanism for inserting yarn into a knitted pocket.

FIG. 11 shows a mechanism for inserting yarn into a cavity of a knitted pocket, in an illustrative implementation of this invention. In the example shown in FIG. 11, pressurized air is employed to insert the yarn. Specifically, in FIG. 11, yarn 1101 has been threaded through a wide needle 1102 of a syringe 1103. The piston of the syringe 1103 has been removed. The rear end of the syringe (which was formerly sealed by the piston) has instead been sealed by seal 1104. The yarn 1101 has also been threaded through a narrow hole 1105 in seal 1104. An additional seal 1106 forms a substantially airtight seal around hole 1105 and around yarn 1101, where yarn 1101 passes through hole 1105. Also, in FIG. 11, a hole 1107 has been drilled in the side of the syringe. Tube 1108 passes through hole 1107. Needle 1102 has been inserted through a gap in a wall of knitted pocket 1109. (This gap may be narrower, in actual practice, than is shown in FIG. 11.)

In FIG. 11, pressurized air moves through tube 1108, then through hole 1107 into the barrel of the syringe 1103, and then out the wide needle 1102 of syringe 1103. As the pressurized air moves through needle 1102 and then exits needle 1102, the pressurized air pulls and/or pushes the portion of yarn 1101 that is in needle 1102, thereby causing that portion of yarn 1101 to be ejected at high speed from needle 1102. When a portion of yarn 1101 exits needle 1102, another portion of yarn 1101 may enter the rear end of the syringe 1103 through hole 1105. The portion of yarn 1101 that is ejected from needle 1102 may travel at high speed into knitted pocket 1109. In some cases, a tail portion of yarn 1101 remains outside of knitted pocket 1109 after the pocket has been filled with loose yarn. This tail portion may be cut off.

Sensor System or Control System

In some implementations of this invention, a transducer described above is part of a sensor system or control system.

For instance, a pleated resistive strain sensor (such as that shown in FIGS. 5A, 5B, 5C and 5D) may be electrically connected to a voltage divider, which in turn is electrically connected to an ADC (analog-to-digital converter) that converts analog voltage to digital data. A microprocessor, microcontroller or other computer may convert this digital data into strain readings or stress readings.

Likewise, a rheostat (such as that shown in FIG. 6 or that shown in FIG. 7) may be electrically connected to a voltage divider, which in turn is electrically connected to an ADC that converts analog voltage to digital data. A microprocessor, microcontroller or other computer may convert this digital data into set points that control another device. For instance, a microprocessor may, based on the digital data, output control signals that: (a) control settings of lighting produced by luminaires; (b) settings of a stove or other heater; (c) settings of an air conditioning system; or (d) a speed setting or other setting of a motor or engine.

Likewise, a resistive strain sensor that includes conductive infill yarn (such as the sensor shown in FIGS. 8A and 8B) may be electrically connected to a voltage divider, which in turn is electrically connected to an ADC that converts analog voltage to digital data. A microprocessor, microcontroller or other computer may convert this digital data into strain readings or stress readings.

Furthermore, a capacitive sensor that includes insulative infill yarn (such as the single-plate capacitive sensor shown in FIGS. 9A and 9B or the double-plate capacitive sensor shown in FIGS. 10A and 10B) may be electrically connected (e.g., by one or more metal wires) to capacitive sensing electronics that detect capacitance and convert this capacitance into digital data. A microprocessor, microcontroller or other computer may convert this digital data into pressure, proximity or distance readings.

Figure 12:
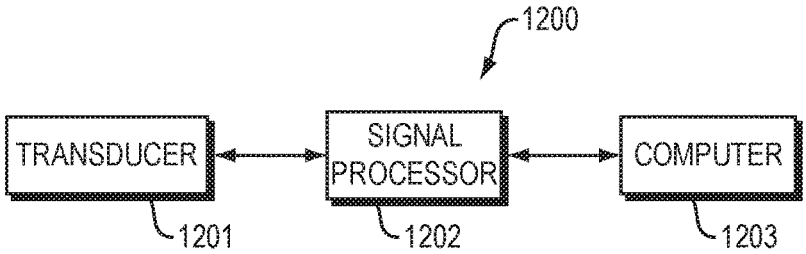
FIG. 12 shows hardware of a system.

FIG. 12 shows hardware of a system 1200, in an illustrative implementation of this invention. System 1200 comprises a sensor system or a control system. System 1200 includes a transducer 1201, signal processor 1202 and computer 1203.

In the example shown in FIG. 12, transducer 1201 comprises a sensor (or rheostat) that: (a) includes a knitted material; and (b) is described above (e.g., a pleated resistive pressure sensor, a belt rheostat, a magnet rheostat, a resistive pressure sensor that includes conductive infill yarns, or a capacitive sensor that includes insulative infill yarn). In FIG. 12, signal processor 1202 converts a signal received from transducer 1201 into digital data. Signal processor 1202 may include one or more of a voltage divider, an ADC and capacitive sensing electronics. Computer 1203 processes the digital data and outputs sensor readings or control signals.

Applications

This invention has many practical applications. Here are three non-limiting examples.

(1) A tablecloth may include multiple rheostats (e.g., a rheostat shown in FIGS. 7A, 7B and 7C). In each of these rheostats, voltage may be varied by moving a moveable magnet. The voltage outputs of these rheostats may be employed to control lighting produced by multiple luminaires in a room.

(2) A belt rheostat (such as that shown in FIGS. 6A and 6B) may control voltage of current that passes through an LED (light emitting diode). Thus, the belt rheostat may control the brightness or dimness of light emitted by the LED. The belt rheostat may be sewn or knitted into a backpack.

(3) Single plate capacitive sensors (each being a sensor shown in FIGS. 9A and 9B) may be attached to a handbag. The handbag may house a battery powered speaker. The handbag may be used as a protective storage bag for the speaker, as well as a musical instrument/controller when unzipped and flattened onto a surface. The instrument may produce a percussive (drumming) sound. This sound may be mapped to different parameters. Detection of touch by the capacitive sensors may be mapped to trigger percussive samples, while pressure measured by the capacitive sensors may be mapped to the sample rate. This percussive instrument may synthesize the percussive sound using the Mozzi library, running on a Teensy® 3.2 development board. The built-in capacitive touch inputs and 12-bit DAC (digital-to-analog converter) of the Teensy® 3.2 development board may enable the instrument to produce rich sounds.

Computers

In illustrative implementations of this invention, one or more computers (e.g., servers, network hosts, client computers, integrated circuits, microcontrollers, controllers, microprocessors, field-programmable-gate arrays, personal computers, digital computers, driver circuits, or analog computers) are programmed or specially adapted to perform one or more of the following tasks: (1) to control the operation of, or interface with, hardware components of a sensor system or control system; (2) to receive data from a rheostat and to convert that data into control signals which control one or more other devices; (3) to receive data from, control, or interface with one or more sensors, including any strain sensor, rheostat, pressure sensor, distance sensor or proximity sensor; (4) to perform any other calculation, computation, program, algorithm, or computer function described or implied herein; (5) to receive signals indicative of human input; (6) to output signals for controlling transducers for outputting information in human perceivable format; (7) to process data, to perform computations, and to execute any algorithm or software; and (8) to control the read or write of data to and from memory devices (tasks 1-8 of this sentence being referred to herein as the "Computer Tasks"). The one or more computers (e.g. 1203) may, in some cases, communicate with each other or with other devices: (a) wirelessly, (b) by wired connection, (c) by fiber-optic link, or (d) by a combination of wired, wireless or fiber optic links.

In exemplary implementations, one or more computers are programmed to perform any and all calculations, computations, programs, algorithms, computer functions and computer tasks described or implied herein. For example, in some cases: (a) a machine-accessible medium has instructions encoded thereon that specify steps in a software program; and (b) the computer accesses the instructions encoded on the machine-accessible medium, in order to determine steps to execute in the program. In exemplary implementations, the machine-accessible medium may comprise a tangible non-transitory medium. In some cases, the machine-accessible medium comprises (a) a memory unit or (b) an auxiliary memory storage device. For example, in some cases, a control unit in a computer fetches the instructions from memory.

In illustrative implementations, one or more computers execute programs according to instructions encoded in one or more tangible, non-transitory, computer-readable media. For example, in some cases, these instructions comprise instructions for a computer to perform any calculation, computation, program, algorithm, or computer function described or implied herein. For instance, in some cases, instructions encoded in a tangible, non-transitory, computer-accessible medium comprise instructions for a computer to perform the Computer Tasks.

Network Communication

In illustrative implementations of this invention, one or more electronic devices are each configured for wireless or wired communication with other devices in a network.

For example, in some cases, one or more of these electronic devices each include a wireless module for wireless communication with other devices in a network. Each wireless module may include (a) one or more antennas, (b) one or more wireless transceivers, transmitters or receivers, and (c) signal processing circuitry. Each wireless module may receive and transmit data in accordance with one or more wireless standards.

In some cases, one or more of the following hardware components are used for network communication: a computer bus, a computer port, network connection, network interface device, host adapter, wireless module, wireless card, signal processor, modem, router, cables and wiring.

In some cases, one or more computers (e.g., 1203) are programmed for communication over a network. For example, in some cases, one or more computers are programmed for network communication: (a) in accordance with the Internet Protocol Suite, or (b) in accordance with any other industry standard for communication, including any USB standard, ethernet standard (e.g., IEEE 802.3), token ring standard (e.g., IEEE 802.5), or wireless communication standard, including IEEE 802.11 (Wi-Fi®), IEEE 802.15 (Bluetooth®/Zigbee®), IEEE 802.16, IEEE 802.20, GSM (global system for mobile communications), UMTS (universal mobile telecommunication system), CDMA (code division multiple access, including IS-95, IS-2000, and WCDMA), LTE (long term evolution), or 5G (e.g., ITU IMT-2020).

DEFINITIONS

The terms "a" and "an", when modifying a noun, do not imply that only one of the noun exists. For example, a statement that "an apple is hanging from a branch": (i) does not imply that only one apple is hanging from the branch; (ii) is true if one apple is hanging from the branch; and (iii) is true if multiple apples are hanging from the branch.

"AC" means alternating current.

To compute "based on" specified data means to perform a computation that takes the specified data as an input.

The term "comprise" (and grammatical variations thereof) shall be construed as if followed by "without limitation". If A comprises B, then A includes B and may include other things.

A digital computer is a non-limiting example of a "computer". An analog computer is a non-limiting example of a "computer". A computer that performs both analog and digital computations is a non-limiting example of a "computer". However, a human is not a "computer", as that term is used herein.

"Computer Tasks" is defined above.

"Conductive" and "conductor" are defined above.

"Defined Term" means a term or phrase that is set forth in quotation marks in this Definitions section.

"Density" is defined above.

For an event to occur "during" a time period, it is not necessary that the event occur throughout the entire time period. For example, an event that occurs during only a portion of a given time period occurs "during" the given time period.

The term "e.g." means for example.

"Electrical short" means an electrical short circuit.

The fact that an "example" or multiple examples of something are given does not imply that they are the only instances of that thing. An example (or a group of examples) is merely a non-exhaustive and non-limiting illustration.

As used herein, to say that an electrode "extends through" a wall describes a spatial position of the electrode relative to the wall and does not describe a movement of the electrode. For instance, FIGS. 8A and 8B show that electrodes 803 and 804 each "extend through" a wall of pocket 801.

Unless the context clearly indicates otherwise: (1) a phrase that includes "a first" thing and "a second" thing does not imply an order of the two things (or that there are only two of the things); and (2) such a phrase is simply a way of identifying the two things, so that they each may be referred to later with specificity (e.g., by referring to "the first" thing and "the second" thing later). For example, unless the context clearly indicates otherwise, if an equation has a first term and a second term, then the equation may (or may not) have more than two terms, and the first term may occur before or after the second term in the equation. A phrase that includes a "third" thing, a "fourth" thing and so on shall be construed in like manner.

"For instance" means for example.

To say a "given" X is simply a way of identifying the X, such that the X may be referred to later with specificity. To say a "given" X does not create any implication regarding X. For example, to say a "given" X does not create any implication that X is a gift, assumption, or known fact.

"Herein" means in this document, including text, specification, claims, abstract, and drawings.

As used herein: (1) "implementation" means an implementation of this invention; (2) "embodiment" means an embodiment of this invention; (3) "case" means an implementation of this invention; and (4) "use scenario" means a use scenario of this invention.

The term "include" (and grammatical variations thereof) shall be construed as if followed by "without limitation".

"Insulative" and "insulator" are defined above.

Unless the context clearly indicates otherwise, "or" means and/or. For example, A or B is true if A is true, or B is true, or both A and B are true. Also, for example, a calculation of A or B means a calculation of A, or a calculation of B, or a calculation of A and B.

As used herein, "pocket" means a structure that at least partially surrounds a cavity.

As used herein, the term "set" does not include a group with no elements.

Unless the context clearly indicates otherwise: (a) the noun "short" (by itself, without any modifying adjective) means an electrical short circuit; and (b) the verb "to short" means to create an electrical short circuit.

Unless the context clearly indicates otherwise, "some" means one or more.

As used herein, a "subset" of a set consists of less than all the elements of the set.

The term "such as" means for example.

To say that a machine-readable medium is "transitory" means that the medium is a transitory signal, such as an electromagnetic wave.

"User" means a human user.

A non-limiting example of a "yarn" is a yarn that comprises synthetic material.

Except to the extent that the context clearly requires otherwise, if steps in a method are described herein, then the method includes variations in which: (1) steps in the method occur in any order or sequence, including any order or sequence different than that described herein; (2) any step or steps in the method occur more than once; (3) any two steps occur the same number of times or a different number of times during the method; (4) any combination of steps in the method is done in parallel or serially; (5) any step in the method is performed iteratively; (6) a given step in the method is applied to the same thing each time that the given step occurs or is applied to a different thing each time that the given step occurs; (7) one or more steps occur simultaneously; or (8) the method includes other steps, in addition to the steps described herein.

Headings are included herein merely to facilitate a reader's navigation of this document. A heading for a section does not affect the meaning or scope of that section.

This Definitions section shall, in all cases, control over and override any other definition of the Defined Terms. The Applicant or Applicants are acting as his, her, its or their own lexicographer with respect to the Defined Terms. For example, the definitions of Defined Terms set forth in this Definitions section override common usage and any external dictionary. If a given term is explicitly or implicitly defined in this document, then that definition shall be controlling, and shall override any definition of the given term arising from any source (e.g., a dictionary or common usage) that is external to this document. If this document provides clarification regarding the meaning of a particular term, then that clarification shall, to the extent applicable, override any definition of the given term arising from any source (e.g., a dictionary or common usage) that is external to this document. Unless the context clearly indicates otherwise, any definition or clarification herein of a term or phrase applies to any grammatical variation of the term or phrase, taking into account the difference in grammatical form. For example, the grammatical variations include noun, verb, participle, adjective, and possessive forms, and different declensions, and different tenses.

Variations

This invention may be implemented in many different ways. Here are some non-limiting examples:

In some implementations, this invention is a sensor comprising: (a) a knitted, insulative pocket; (b) a first knitted electrode and a second knitted electrode that are each positioned in such a way as to extend through a wall of the knitted pocket; and (c) yarns (interior yarns) that (i) are inside a cavity of the knitted pocket, (ii) touch an interior surface of the cavity but are not attached to the interior surface, (iii) are neither woven, nor knitted, nor otherwise comprise part of a fabric, (iv) comprise one or more conductive yarns and one or more insulative yarns, and (v) are positioned in such a way that (A) the first and second electrodes each touch at least one of the one or more conductive yarns, and (B) electrical resistance of the interior yarns decreases when pressure on the knitted pocket causes density of the interior yarns in the cavity to increase. In some cases: (a) the sensor is configured to measure the electrical resistance of the interior yarns; (b) the sensor further comprises a computer; and (c) the computer calculates the pressure, based on the electrical resistance. In some cases, the interior yarns are sufficiently rigid that, when a user presses against the knitted pocket, the interior yarns provide mechanical resistance that creates tactile feedback for the user. In some cases, the interior yarns are not bonded to each other by a chemical or mechanical bond. In some cases, the knitted pocket includes: (a) insulative yarn; and (b) thermoplastic material that is attached to or fused with the insulative yarn. Each of the cases described above in this paragraph is an example of the sensor described in the first sentence of this paragraph, and is also an example of an embodiment of this invention that may be combined with other embodiments of this invention.

In some implementations, this invention is a sensor comprising: (a) a knitted, insulative layer; and (b) a spatial sequence of knitted, conductive pleats that are attached to the insulative layer; wherein (i) a first pleat of the sequence is electrically connected to a first node of an electrical circuit and a second pleat of the sequence is electrically connected to a second node of the electrical circuit, and (ii) the pleats are configured in such a way that (A) neighboring pleats in the sequence touch each other in contact regions, (B) electrical shorts between the neighboring pleats occur in the contact regions, and (C) as the insulative layer becomes increasingly stretched due to tensile stress, neighboring pleats in the sequence slide at least partially past each other, thereby reducing total area of the contact regions and causing electrical resistance of the spatial sequence of pleats to increase. In some cases: (a) the sensor further comprises a computer; and (b) the computer calculates, based on the electrical resistance, strain of the sensor. In some cases: (a) the sensor further comprises a computer; and (b) the computer calculates, based on the electrical resistance, the stress. In some cases, the insulative layer comprises a polyether-polyurea copolymer. In some cases, the insulative layer comprises spandex. In some cases, the pleats are not interdigitated. In some cases, the neighboring pleats are not physically attached to each other. In some cases: (a) the neighboring pleats include a pair of pleats; (b) the pair of pleats consists of a first pleat and a second pleat; (c) in a contact region between the first pleat and the second pleat (i) the first and second pleats touch each other, and (ii) yarn in the first pleat is neither knitted to, nor interwoven with, yarn in the second pleat. In some cases: (a) the neighboring pleats include a pair of pleats; (b) the pair of pleats consists of a first pleat and a second pleat; (c) in a contact region between the first pleat and the second pleat (i) the first and second pleats touch each other, and (ii) yarn in the first pleat is neither knitted to, nor interwoven with, nor fused with, nor mechanically bonded with, yarn in the second pleat. Each of the cases described above in this paragraph is an example of the sensor described in the first sentence of this paragraph, and is also an example of an embodiment of this invention that may be combined with other embodiments of this invention.

In some implementations, this invention is a capacitive sensor comprising: (a) a knitted pocket that includes a knitted, conductive wall; and (b) one or more yarns (interior yarns) that (i) are insulative, (ii) are inside a cavity of the knitted pocket, (ii) touch an interior surface of the cavity but are not attached to the interior surface, and (iii) are neither woven, nor knitted, nor otherwise comprise part of a fabric; wherein the capacitive sensor is configured to measure capacitance between the conductive wall and a human user. In some cases, the interior yarns are sufficiently rigid that, when the user presses against the knitted pocket, the interior yarns provide mechanical resistance that creates tactile feedback for the user. In some cases: (a) the sensor further comprises a computer; and (b) the computer is programmed to calculate, based on the capacitance, a distance between the conductive wall and the user. In some cases: (a) the sensor further comprises a computer; and (b) the computer is programmed to detect proximity of the user, based on the capacitance. In some cases: (a) the sensor further comprises a computer; and (b) the computer is programmed to calculate, based on the capacitance, a force or pressure exerted by the user against the knitted pocket. In some cases, the sensor: (a) further comprises a knitted electrode; and (b) is configured to measure the capacitance while (i) the knitted electrode is electrically grounded and (ii) the user is touching the knitted electrode. Each of the cases described above in this paragraph is an example of the capacitive sensor described in the first sentence of this paragraph, and is also an example of an embodiment of this invention that may be combined with other embodiments of this invention.

Each description herein (or in the Provisional) of any method, apparatus or system of this invention describes a non-limiting example of this invention. This invention is not limited to those examples, and may be implemented in other ways.

Each description herein (or in the Provisional) of any prototype of this invention describes a non-limiting example of this invention. This invention is not limited to those examples, and may be implemented in other ways.

Each description herein (or in the Provisional) of any implementation, embodiment or case of this invention (or any use scenario for this invention) describes a non-limiting example of this invention. This invention is not limited to those examples, and may be implemented in other ways.

Each Figure, diagram, schematic or drawing herein (or in the Provisional) that illustrates any feature of this invention shows a non-limiting example of this invention. This invention is not limited to those examples, and may be implemented in other ways.

The above description (including without limitation any attached drawings and figures) describes illustrative implementations of the invention. However, the invention may be implemented in other ways. The methods and apparatus which are described herein are merely illustrative applications of the principles of the invention. Other arrangements, methods, modifications, and substitutions by one of ordinary skill in the art are also within the scope of the present invention. Numerous modifications may be made by those skilled in the art without departing from the scope of the invention. Also, this invention includes without limitation each combination and permutation of one or more of the items (including any hardware, hardware components, methods, processes, steps, software, algorithms, features, and technology) that are described herein.

What is claimed:

1. A sensor comprising:
(a) a knitted, insulative pocket;
(b) a first knitted electrode and a second knitted electrode that are each positioned in such a way as to extend through a wall of the knitted, insulative pocket; and
(c) infill yarns that
  (i) are inside a cavity of the knitted, insulative pocket,
  (ii) touch an interior surface of the cavity but are not attached to the interior surface,
  (iv) comprise one or more conductive yarns and one or more insulative yarns, and
  (v) are positioned in such a way that
    (A) the first and second electrodes each touch at least one of the one or more conductive yarns, and
    (B) electrical resistance of the infill yarns decreases when pressure on the knitted, insulative pocket causes density of the infill yarns in the cavity to increase.

2. The sensor of claim 1, wherein:
(a) the sensor is configured to measure the electrical resistance of the infill yarns;
(b) the sensor further comprises a computer; and
(c) the computer calculates the pressure, based on the electrical resistance.

3. The sensor of claim 1, wherein the infill yarns are sufficiently rigid that, when a user presses against the knitted, insulative pocket, the infill yarns provide mechanical resistance that creates tactile feedback for the user.

4. The sensor of claim 1, wherein the infill yarns are not bonded to each other by a chemical or mechanical bond.

5. The sensor of claim 1, wherein the knitted, insulative pocket includes: (a) insulative yarn; and (b) thermoplastic material that is attached to or fused with the insulative yarn.

6. A sensor comprising:
(a) a knitted, insulative layer; and
(b) a spatial sequence of knitted, conductive pleats that are attached to the insulative layer;
wherein
  (i) a first pleat of the sequence is electrically connected to a first node of an electrical circuit and a second pleat of the sequence is electrically connected to a second node of the electrical circuit, and
  (ii) the pleats are configured in such a way that
    (A) neighboring pleats in the sequence touch each other in contact regions,
    (B) electrical shorts between the neighboring pleats occur in the contact regions, and
    (C) as the insulative layer becomes increasingly stretched due to tensile stress, neighboring pleats in the sequence slide at least partially past each other, thereby reducing total area of the contact regions and causing electrical resistance of the spatial sequence of pleats to increase.

7. The sensor of claim 6, wherein:
(a) the sensor further comprises a computer; and
(b) the computer calculates, based on the electrical resistance, strain of the sensor.

8. The sensor of claim 6, wherein:
(a) the sensor further comprises a computer; and
(b) the computer calculates, based on the electrical resistance, the stress.

9. The sensor of claim 6, wherein the insulative layer comprises a polyether-polyurea copolymer.

10. The sensor of claim 6, wherein the insulative layer comprises spandex.

11. The sensor of claim 6, wherein the pleats are not interdigitated.

12. The sensor of claim 6, wherein the neighboring pleats are not physically attached to each other.

13. The sensor of claim 6, wherein:

(a) the neighboring pleats include a pair of pleats;

(b) the pair of pleats consists of a first pleat and a second pleat;

(c) in a contact region between the first pleat and the second pleat (i) the first and second pleats touch each other, and (ii) yarn in the first pleat is neither knitted to, nor interwoven with, yarn in the second pleat.

14. The sensor of claim 6, wherein:

(a) the neighboring pleats include a pair of pleats;

(b) the pair of pleats consists of a first pleat and a second pleat;

(c) in a contact region between the first pleat and the second pleat (i) the first and second pleats touch each other, and (ii) yarn in the first pleat is neither knitted to, nor interwoven with, nor fused with, nor mechanically bonded with, yarn in the second pleat.

* * * * *